US005987296A

United States Patent [19]

Shimada et al.

[11] Patent Number: 5,987,296

[45] Date of Patent: Nov. 16, 1999

[54] FIXING DEVICE WITH HEAT ROLLER HAVING HEATING RESISTOR LAYER THEREIN

[75] Inventors: Takeichi Shimada; Tetsuko Omoto; Seiji Yamaguchi, all of Hachioji, Japan

[73] Assignee: Konica Corporation, Japan

[21] Appl. No.: 09/157,304

[22] Filed: Sep. 18, 1998

[30] Foreign Application Priority Data

Sep. 24, 1997 [JP] Japan ..... 9-258237
Sep. 24, 1997 [JP] Japan ..... 9-258238
Sep. 24, 1997 [JP] Japan ..... 9-258239

[51] Int. Cl.[6] ..... G03G 15/20

[52] U.S. Cl. ..... 399/330; 399/320

[58] Field of Search ..... 219/216, 244, 219/469, 470, 543; 399/330, 320, 328, 332, 333, 334

[56] References Cited

U.S. PATENT DOCUMENTS 5,094,613 3/1992 Dolcimascolo et al. ..... 432/60
5,575,942 11/1996 Watanabe ..... 219/469

*Primary Examiner*—Robert Beatty
*Assistant Examiner*—Hoang Ngo
*Attorney, Agent, or Firm*—Jordan B. Bierman; Bierman, Muserlian and Lucas

[57] ABSTRACT

A fixing apparatus includes: a cylindrical heat roller having a heating resistor layer on an inside surface thereof; a pressure member in pressure contact with the cylindrical heat roller; and a pair of electrodes provided in the cylindrical heat roller for supplying electricity to the heating resistor layer so that the heating resistor layer generates heat. Both ends of the cylindrical heat roller are formed so as to restrain radiating heat in the cylindrical heat roller from openings at the both ends of the cylindrical heat roller.

10 Claims, 11 Drawing Sheets

FIXING DEVICE WITH HEAT ROLLER HAVING HEATING RESISTOR LAYER THEREIN

BACKGROUND OF THE INVENTION

The present invention relates to a fixing device employing a cylindrical heat roller having on its inner wall a heating resistor layer.

As a heat roller used for a fixing device of an image forming apparatus, those each of them has in its hollow portion a heating source such as an infrared lamp, a halogen lamp or a Nichrome wire have been used commonly.

However, in the heat roller having the structure mentioned above, the roller is heated indirectly through air by radiant heat of a heat source. Therefore, there has been a problem that thermal efficiency is poor and the length of time for the surface of the heat roller to arrive at the prescribed temperature (preheating time) is long.

It has therefore been proposed a method to heat a roller directly by forming a heating resistor layer such as a ceramic heater on a circumferential surface of the heater.

However, the aforesaid heat roller to heat a roller directly is a straight roller wherein the outside diameter of the roller which comes in contact with a recording material is the same as the outside diameter which does not come in contact with a recording material.

In the case of this straight roller, therefore, an area exposed to the open air on each of both end portions of the roller is broader than that on the middle portion of the roller, and an amount of heat radiated from both end portions of the roller is greater accordingly, resulting in ill-balanced temperature gradient in the axial direction of the roller.

Namely, temperatures at both end portions tend to be lower than that on the middle portion of the roller, due to radiation of heat from an outer circumferential surface, an inner circumferential surface and end faces of the roller.

This phenomenon is not only dependent on the surface area of the end faces of the roller but also influenced by an air flow surrounding the roller. This point will be explained concretely as follows.

When a roller is heated and heat is radiated into air, a temperature difference between the temperature inside the roller and that in the open air is caused to generate a convection current. In this case, as shown in FIG. 4, power-supply portion E provided on the end portion of roller R is provided with several holes to form an opening.

Therefore, exchange is made between air inside the roller R heated positively and air surrounding the roller. When the roller R is considered to be divided into both end portions and the middle portion, both end portions of the roller R are subjected to air exchange because they are provided with openings, but the temperature difference is hard to be caused on the middle portion of the roller because of the heat of both end portions adjoining each other, and thereby, air exchange is hard to be made.

Therefore, the temperature difference is caused between both end portions where air exchange is made positively and the middle portion where the air exchange is hardly made.

Namely, when the temperature at both end portions of the roller is set to the reference temperature, the temperature at the middle portion of the roller turns out to be higher than the reference temperature, while when the temperature at the middle portion of the roller is set to the reference temperature, the temperature at the both end portions of the roller turns out to be lower than the reference temperature.

In the case wherein a roller having the structure mentioned above is used for a fixing device of an image forming apparatus, when the temperature at both end portions of the roller is set to the reference temperature, the temperature at the middle portion of the roller turns out to be higher than the reference temperature, resulting in occurrence of hot offset when a narrow recording material is fixed continuously.

On the contrary, when the temperature at the middle portion of the roller is set to the reference temperature, the temperature at the both end portions of the roller turns out to be lower than the reference temperature, resulting in occurrence of under fixing when a broad recording material is fixed continuously.

However, in the case of the aforesaid roller to heat a roller directly, width (WR) of heating resistor layer RL which is formed on a circumferential surface of heat roller HR is set to the maximum width size (maximum width paper (WPmax)) among recording sheets P to be conveyed, as shown in FIG. 11 (a). For example, when recording sheets to be conveyed are composed of four types of A3, A4, B4 and B5, the width of heating resistor layer RL is set to the width of A3 recording sheet representing the maximum width size or greater.

In the fixing device having the structure mentioned above, temperature distribution in the axial direction of heat roller HR in the case of fixing the recording sheet having the maximum width size is inside the range between the upper limit of optimum temperature (UOT) and the lower limit of optimum temperature (LOT) as shown in FIG. 12, though the temperature distribution at both end portions of the roller are lowered because of heat radiation, resulting in satisfactory fixing.

However, when a recording sheet having a small width size is conveyed, the temperature of heating resistor layer RL of non-contact portion (the portion outside the width of the recording sheet) of a heat roller rises, and the surface of heat roller HR is partially deteriorated, reducing the duration of life of the heat roller HR, which is a problem.

When a recording sheet having the maximum width size is conveyed right after the temperature of heating resistor layer RL of non-contact portion rises, high temperature offset is caused because temperatures at both end portions of the heat roller HR are higher than the upper limit of optimum temperature, and deterioration of a fixed image is caused, which is also a problem.

SUMMARY OF THE INVENTION

The invention has been achieved in view of the aforesaid problems, and its object is to provide a heat roller wherein temperature gradient in the axial direction is gentle and a fixing device.

The object stated above can be attained by the following structure.

A fixing apparatus includes: a cylindrical heat roller having a heating resistor layer on an inside surface thereof; a pressure member in pressure contact with the cylindrical heat roller; and a pair of electrodes provided in the cylindrical heat roller for supplying electricity to the heating resistor layer so that the heating resistor layer generates heat. Both ends of the cylindrical heat roller are formed so as to restrain radiating heat in the cylindrical heat roller from openings at the both ends of the cylindrical heat roller.

DETAILED DESCRIPTION OF THE PREFERRED EMBODIMENT

An embodiment of the invention will be explained with reference to the drawings.

Figure 3:
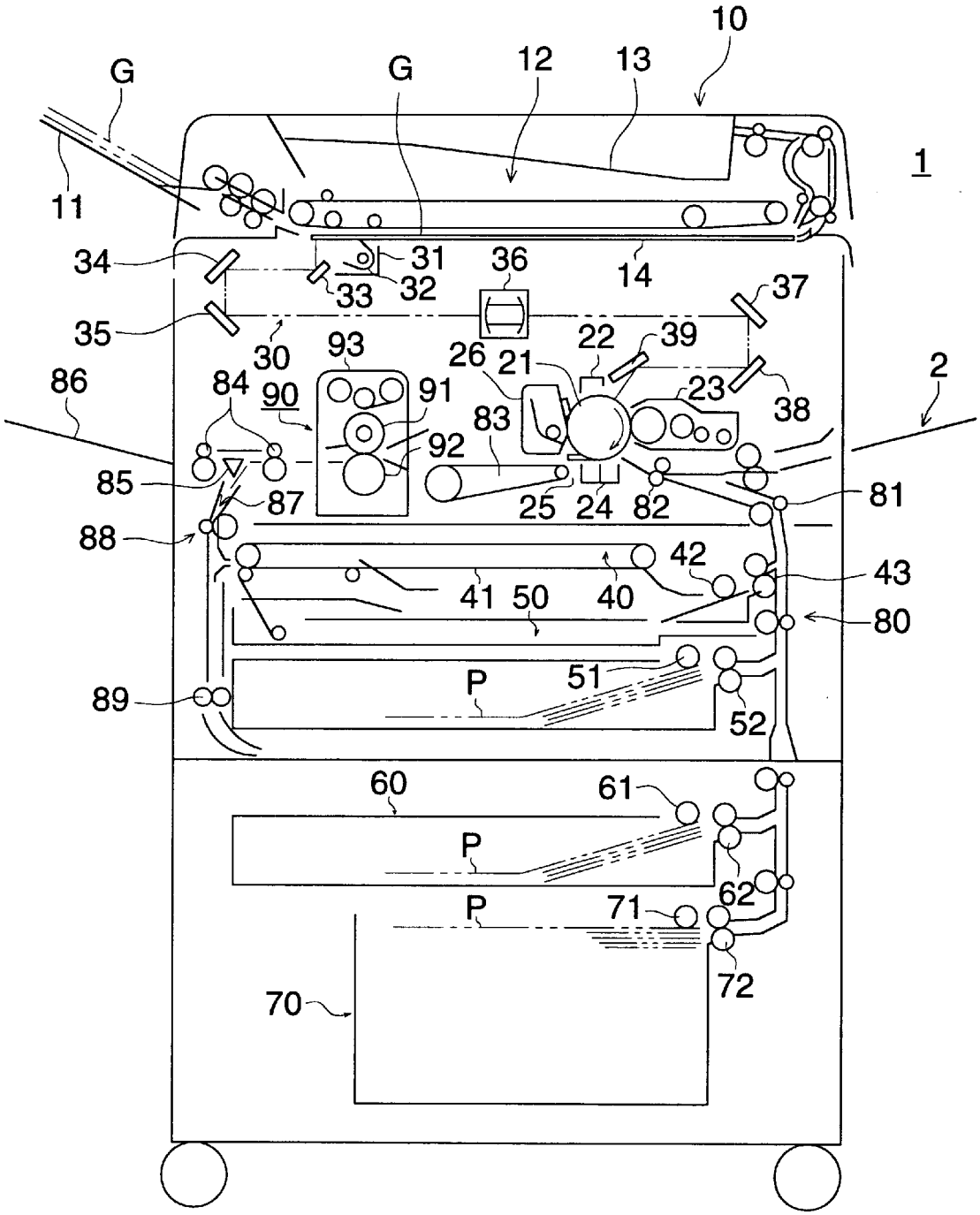
FIG. 3 shows an overall structure of an image forming apparatus equipped with a fixing device in which a heat roller shown in FIG. 1 is employed.
Figure 4:
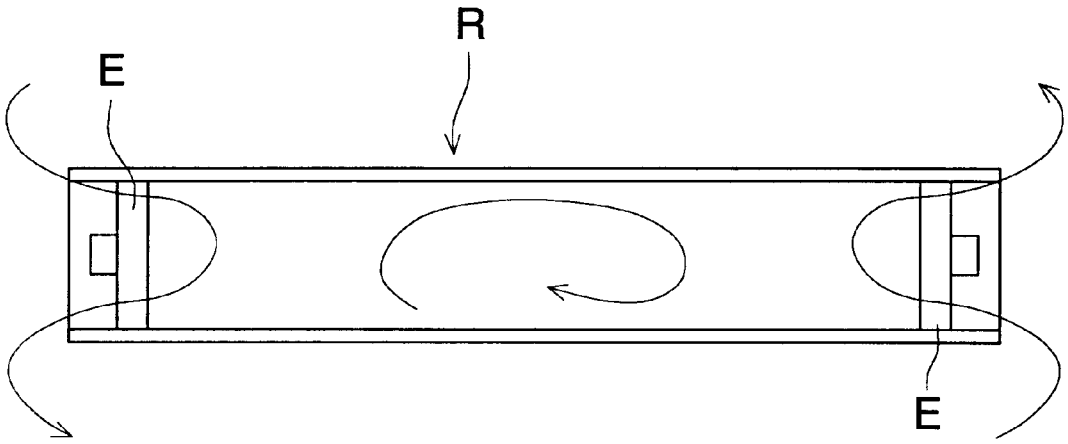
FIG. 4 is a diagram illustrating problems.
Figure 5:
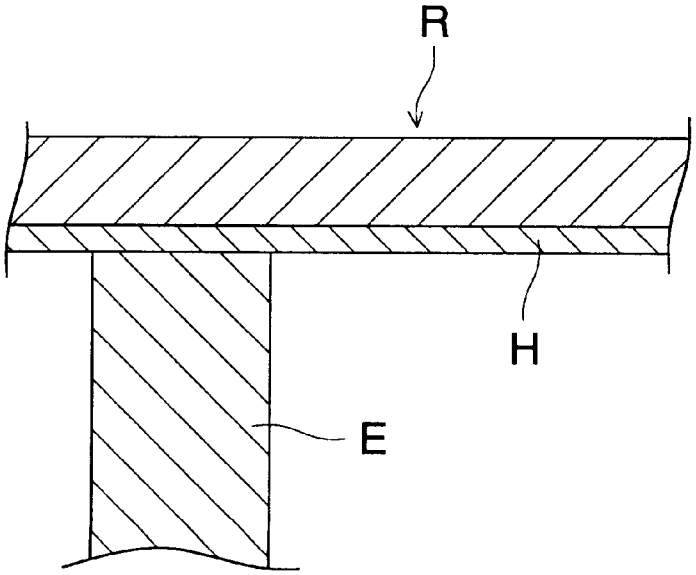
FIG. 5 is a diagram illustrating problems.

First, overall structure and operations of an image forming apparatus provided with a fixing device employing a heat roller in the present embodiment will be explained with reference to FIG. 3. Incidentally, the image forming apparatus will be explained in this case, using an example of a copying machine.

Automatic document feeding device 10 is provided on the upper portion of image forming apparatus 1, and document G set on document loading tray 11 is fed onto document placing plate 14 by conveyance mechanism 12. The document G placed on the document placing plate 14 is ejected out to document-receiving section 13 by the conveyance mechanism 12 at the timing of completion of exposure.

Inside the image forming apparatus 1, charging unit 22, developing unit 23, transfer unit 24, separation unit 25 and cleaning unit 26 are arranged in the order of their operations to surround drum-shaped photoreceptor 21 representing an image forming means, and they are formed integrally as an image forming unit.

After electric charges are given to the surface of a photosensitive layer of the photoreceptor 21 by charging unit 22, exposure by means of exposure lamp 32 provided on optical frame 31 of exposure optical unit 30 arranged on the top portion of the image forming apparatus 1 is started for document G placed on the document placing plate 14 provided at the uppermost portion of the image forming apparatus 1.

Namely, the exposure is conducted in the arrowed direction by mirror 33 which moves solidly with the exposure lamp 32, V-shaped mirrors 34 and 35 which move to cover a half of the distance covered by the mirror 33, mirrors 37 and 38 arranged in a V shape through image-forming lens 36 and mirror 39 which projects images on photoreceptor 21, so that electrostatic latent images may be formed on a photosensitive layers of the photoreceptor 21.

Then, the electrostatic latent images a re developed by developing unit 23 in the image forming unit 20 so that toner images which are visible images are formed on the photosensitive layers of the photoreceptor 21.

Further, there are arranged double-sided copy sheet feeding unit 40 and sheet feeding units 50, 60 and 70 respectively at upper and lower positions in the lower part of the image forming apparatus 1, and each of the sheet feeding units 50, 60 and 70 is loaded with recording sheets P in a different size.

For example, after recording sheet P representing a recording material loaded in the sheet feeding unit 50 is selected, sheet feeding roller 51 feeds a sheet of the recording sheet P which is then conveyed by guide roller 52.

In the same way as in the foregoing, after recording sheets P loaded in the sheet feeding units 60 and 70 are selected, each of sheet feeding rollers 61 and 71 feeds a sheet of the recording sheet P which is then conveyed by each of guide roller 62 and 72.

Then, the recording sheet P is conveyed by conveyance mechanism 81 through conveyance path 80 toward the photoreceptor 21 on which toner images are formed. Then, the recording sheet P is stopped momentarily by register roller 82 provided on the image forming apparatus 1 so that the recording sheet P is synchronized with toner images formed on the photoreceptor 21 to be fed further.

Next, toner images on the photoreceptor 21 are transferred by transfer unit 24 onto the recording sheet P which is then separated from the surface of the photoreceptor 21 by separation unit 25, and is conveyed to fixing unit 90 by conveyance unit 83.

The fixing unit 90 is equipped with heat roller 91 and pressure roller 92 which comes in pressure contact with the heat roller, and when the recording sheet P representing a recording material onto which toner images have been transferred passes through the portion between the heat roller 91 and the pressure roller 92, the toner images are heat-fixed on the recording sheet P.

The recording sheet P completed in terms of fixing is ejected out by sheet ejection guide roller 84. In the case of single-sided copying, sheet ejection switching member 85 is lowered to allow the recording sheet P to be ejected directly on sheet ejection tray 86.

In the case of double-sided copying, th e sheet ejection switching member 85 is lifted, and recording sheet guiding portion 87 is opened, thus, the recording sheet P is conveyed in the direction shown by an arrow mark of broken lines.

Further, the recording sheet P is conveyed downward by the conveyance mechanism 88, then is returned by recording sheet reversing portion 89, and is conveyed to double-sided copy sheet feeding unit 50 with a trailing edge of the recording sheet P serving as a leading edge thereof.

The recording sheet P is moved in the sheet feeding direction by conveyance belt 41 provided on the double-sided copy sheet feeding unit 50, then is fed again by sheet feeding roller 42 and is guided by conveyance roller 43 to conveyance path 80.

The recording sheet P is conveyed again toward the photoreceptor 21 in the same way as in the foregoing, then, toner images are transferred onto the reverse side of the recording sheet P and are fixed by fixing unit 90, and the recording sheet P is ejected out to sheet ejection tray 86. Incidentally, in addition to the sheet feeding mentioned above, image forming apparatus 1 is equipped also with manual insertion sheet feeding unit 2 which is for manual sheet feeding.

(1) FIRST EXAMPLE

Figure 1:
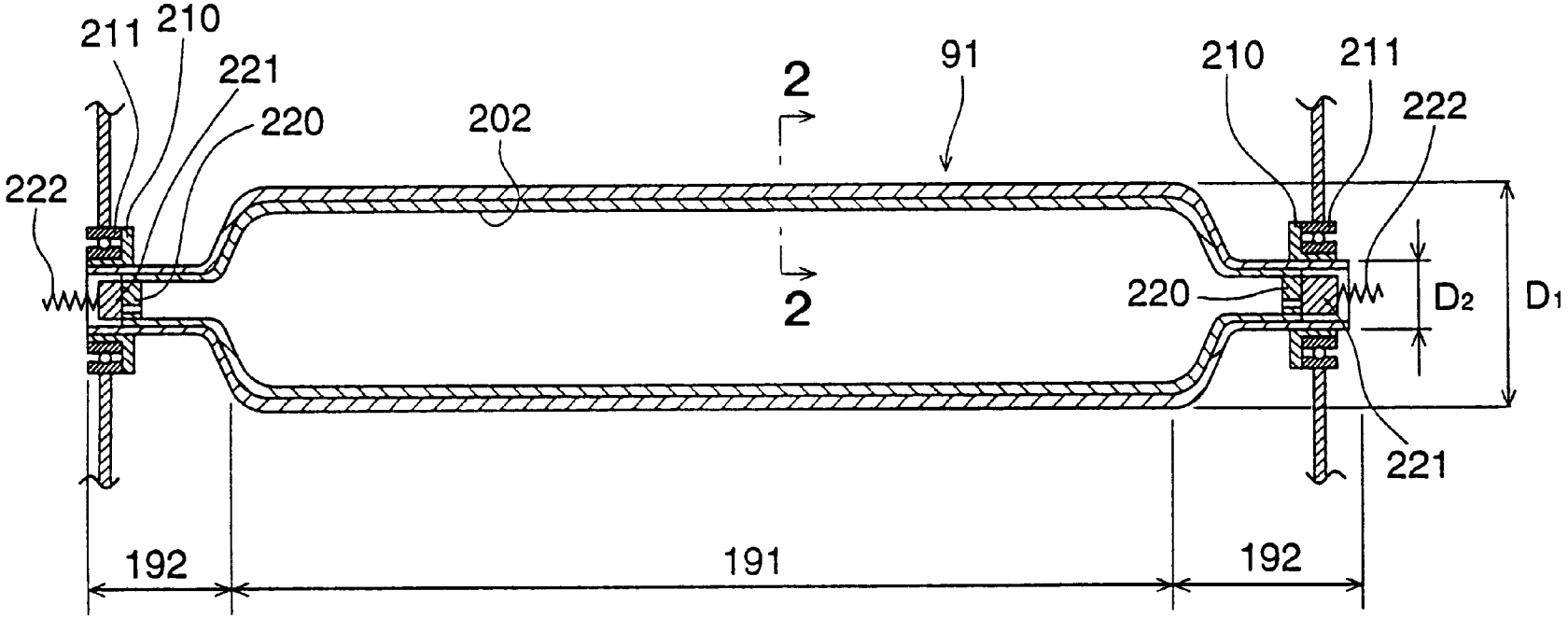
FIG. 1 is a sectional structure diagram of a heat roller in the first example.
Figure 2:
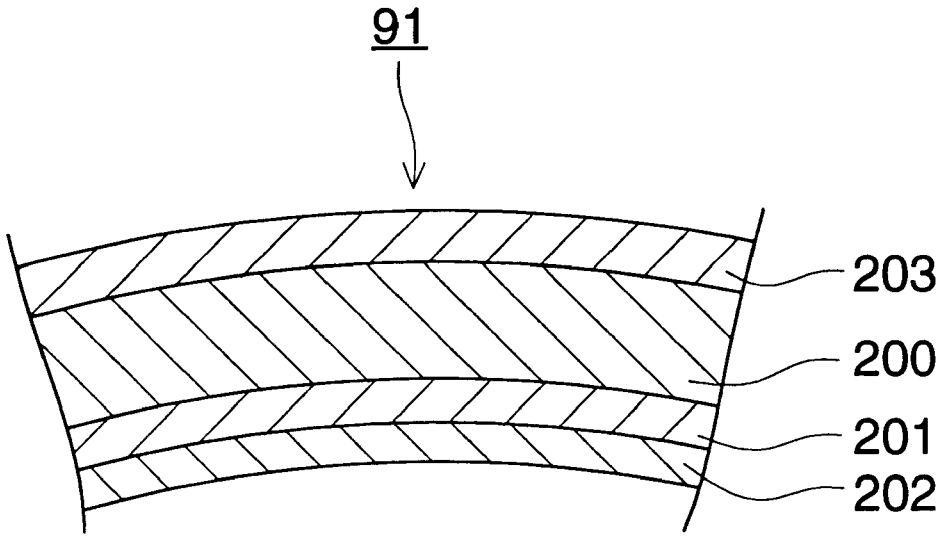
FIG. 2 is a sectional view taken on line A—A in FIG. 1.

Next, heat roller 91 will be explained with reference to FIGS. 1 and 2. FIG. 1 is a sectional structure diagram of a heat roller in the present embodiment, and FIG. 2 is a sectional view taken on line A—A in FIG. 1.

As shown in FIG. 1, hollow heat roller 91 is roughly composed of two portions including a portion that comes in contact with recording sheet P having the maximum width, namely sheet-contact portion 191 through which recording sheet P passes, and a portion which is formed solidly with the sheet-contact portion 191 on both sides thereof and does not come in contact with recording sheet P, namely bearing portion 192. An outside diameter (D2) of the bearing portion 192 is established to be smaller than that (D1) of the sheet-contact portion 191.

When an outside diameter (D2) of the bearing portion 192 is made to be smaller than that (D1) of the sheet-contact portion 191, an opened area of the bearing portion 192 is made to be smaller than that of the sheet-contact portion 191. Namely, in the case of using heat roller 91 having the wall thickness which is almost uniform, when outside diameters of various portions are made to be different each other, there are caused differences in inside diameters of various portions, which results in differences in opened areas of various portions.

On the outer circumferential surface of the bearing portion 192, there is provided bearing holder 210, and bearing 211 which supports heat roller 91 rotatably on the stationary structure such as a panel is provided on the bearing holder 210.

On the inner surface of the hollow heat roller 91, there is formed heating resistor layer 202.

Inside the bearing portion 192, there is provided a power supplying section represented by electrode 220 which has several holes (each actually having a diameter of about 1–2 mm) and is connected electrically to the heating resistor layer 202. These holes serve as vent holes through which air expanded by heat inside the heat roller flows out. The numeral 221 is a slip ring which is provided to slide on the electrode 220 and is impressed with voltage, while 222 is a spring whose one end makes the slip ring 221 to be in pressure contact with the electrode 220 and the other end is supported on a part of the heat roller. The electrode serving as a power supplying section is made of a material having high conductivity such as brass.

As shown in FIG. 2, a section of the heat roller 91 is of a multi-layer structure wherein heating resistor layer 202 is formed on an inner surface of core metal layer 200 through insulating layer 201, and releasing layer 203 is formed on an outer surface of the core metal layer 200.

A method to form heating resistor layer 202 includes painting, coating, evaporation and gluing, and the invention is not limited to them.

In the present embodiment, a core metal layer is made of aluminum (having a thickness of 0.5–2.0 mm), an insulating layer is made of heat resistant insulating resin (having a thickness of 30–60 $\mu$m) such as polyimide, a heating resistor layer is made of low-melting glass containing conductive filler such as silver or zinc oxide, and a releasing layer is made of highly releasable resin (having a thickness of 15–30 $\mu$m) such as silicone or ethylene tetrafluoride.

In the aforesaid structure, outside diameter (D2) of the bearing portion 192 which does not come in contact with recording sheet P representing a recording material is established to be smaller than that (D1) of sheet-contact portion 191 which comes in contact with recording sheet P, and thereby a surface area of the bearing portion 192 is reduced, and an amount of heat radiated to the open air is also reduced.

Therefore, a temperature gradient on heat roller 91 in its axial direction is gentle.

Further, the sheet-contact portion 191 and the bearing portion 192 which are formed solidly to be one body lead to cost reduction.

In addition, bearing 211 which supports heat roller 91 rotatably, electrode 220 which supplies an electric current to heating resistor layer 202 and a diameter of slip ring 221 can be made small, which results in cost reduction.

By providing electrode 220 serving as a power supply section on bearing portion 192 representing a portion which has a small diameter and does not come in contact with recording sheet P, it is possible to make the electrode 220 small.

Therefore, an influence of heat absorption by electrode 220 is less, and a portion where roller temperature is partially lowered by electrode 220 can be located on bearing portion 192 which does not come in contact with an image, thus, a synergistic effect of the foregoing eliminates an influence on how an image is fixed.

Due to the small electrode 220, thermal capacity of the electrode 220 is small. Therefore, the amount of heat of heat roller 91 absorbed by the electrode 220 is small.

As stated above, a temperature gradient of the heat roller in its axial direction can be made gentle in the fixing device of the invention, because heat in the heat roller is hard to be radiated from an opening at the end portion in the axial direction of the heat roller. It is therefore possible to prevent troubles in fixing such as hot offset and under fixing.

(2) SECOND EXAMPLE

Figure 6:
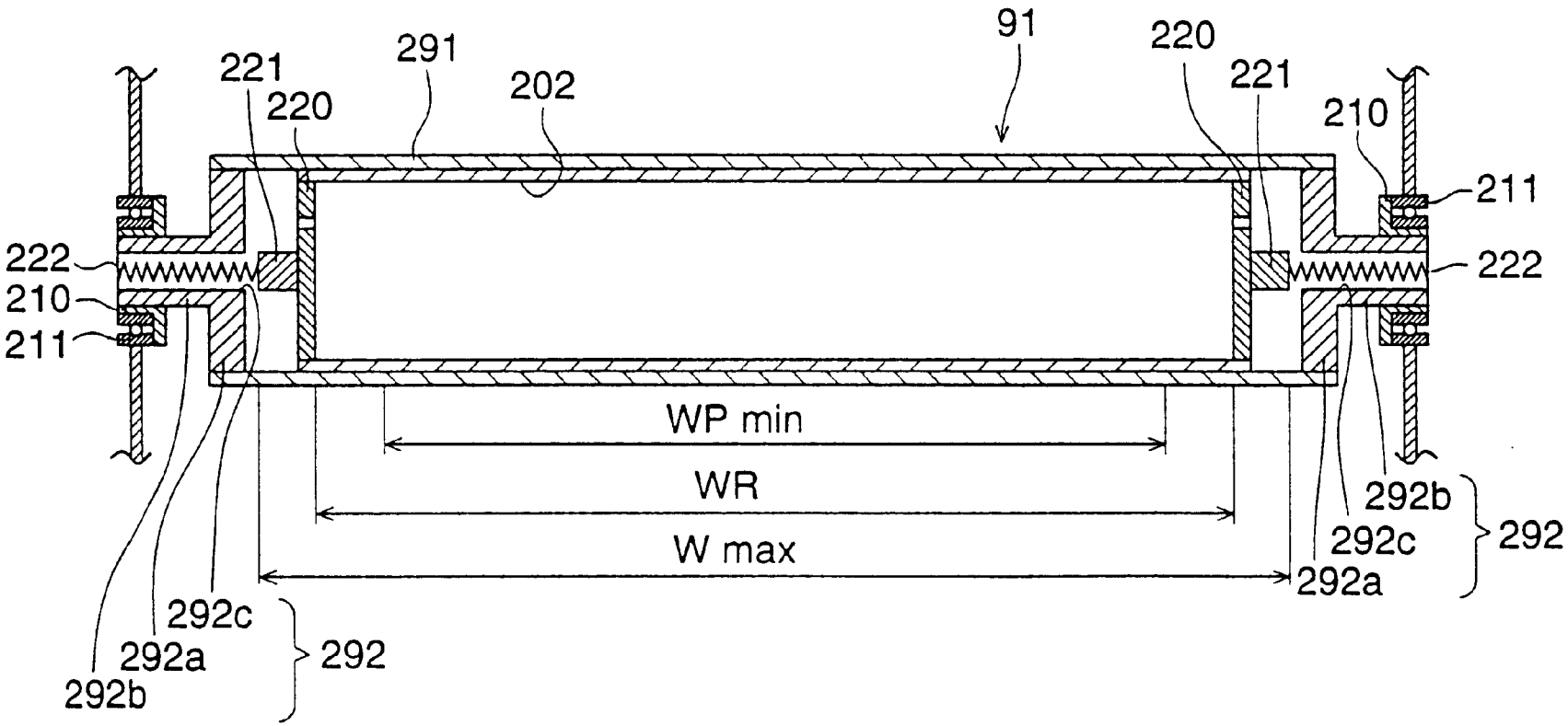
FIG. 6 is a sectional structure diagram of a heat roller in the second example.

Next, heat roller 91 will be explained with reference to FIG. 6. FIG. 6 is a sectional structure diagram of the heat roller in the second example.

In FIG. 6, the numeral 291 represents a cylindrical core metal whose both ends are opened, and the numeral 202 represents a heating resistor layer formed on an inner surface of the core metal 291. Incidentally, the width of the heating resistor layer 202 of the present embodiment in the axial direction of the heat roller 91 is about the maximum width of recording sheet P.

Flange 292 made of a material having coefficient of thermal conductivity that is lower than that of the core metal 291 is fitted in each of both opened ends of the core metal 291. This flange 292 is composed of fitting portion 292*a* which is fitted in an open end of the core metal 291, bearing portion 292*b* whose outside diameter is set to be smaller than that of the core metal 291, and through hole portion 292*c* formed in the axial direction of heat roller 91

On the outer circumferential surface of the bearing portion 292*b*, there is provided bearing holder 210, and bearing 211 which supports the heat roller 91 rotatably on the stationary structure such as a panel is provided on the bearing holder 210. Inside the core metal 291, there is provided electrode 220 which is connected electrically to heating resistor layer 202 by the use of conductive adhesives. Each of the electrodes 220 at both ends has thereon several holes (each actually having a diameter of about 1–2 mm), and these holes serve as vent holes through which air expanded by heat in the heat roller flows out. The numeral 221 represents a conductive slip ring provided to be slidable on the electrode 220, while the numeral 222 is a spring which makes the slip ring 221 to be in pressure contact with conductive electrode 220 such as brass through the through hole portion 292*c* of flange 292.

Therefore, when voltage is impressed on each of slip rings 221 at both ends, th e heating resistor layer 202 generates heat.

As shown in FIG. 2, a section of the heat roller 91 is of a multi-layer structure wherein heating resistor layer 202 is formed on an inner surface of core metal layer 200 through insulating layer 201, and releasing layer 203 is formed on an outer surface of the core metal layer 200.

The flange 292 is made of steel or stainless steel (SUS) whose coefficient of thermal conductivity is lower than that of aluminum core metal 291. Incidentally, at 100° C., coefficient of thermal conductivity of aluminum is 279.1 (Kcal/m.h. ° C.), that of steel is 19.2 (Kcal/m.h. ° C.), and that of stainless steel is 83.1 (Kcal/m.h. ° C.).

On the other hand, a thickness of aluminum for core metal layer 200 was 0.5–2.0 mm, that of insulating layer 201 was 30–60 $\mu$m, that of heating resistor layer 202 was 10–50 $\mu$m and that of releasing layer 203 was 15–30 $\mu$m.

Owing to the aforesaid structure wherein flange 292 is fitted in each of both open ends of core metal 291, a surface area exposed to the open air is reduced at an outer circumferential surface and an inner circumferential surface on both end portions of heat roller 91, compared with an occasion of no flange, namely an occasion of both open ends, whereby, it is possible make the temperature difference in the axial direction small.

Due to a convection generated when heat roller 91 is heated, air exchange at an end portion of the heat roller 91 hardly takes place, and a decline of temperature at an end portion of the heat roller 91 can be controlled.

Further, owing to an arrangement that coefficient of thermal conductivity of a material for flange 292 is lower than that of a material for core metal 291, heat radiation from both ends lessens, whereby, it is possible make the temperature difference in the axial direction of the heat roller 91 small.

Owing to heating resistor layer 202 which is formed on an inner circumferential surface of core metal 291, the core metal 291 serves as a heat reservoir, and heat radiation from both ends lessens, whereby, it is possible to make the temperature difference in the axial direction of the heat roller small.

In addition, owing to the outside diameter of bearing portion 292*b* of flange 292 which is made to be smaller than that of core metal 291, it is possible to make diameters of bearing 211 and bearing holder 210 small, which results in cost reduction.

When replacement is needed due to abrasion of bearing portion 292*b*, flange 292 has only to be replaced, resulting in cost reduction.

(3) THIRD EXAMPLE

Figure 7:
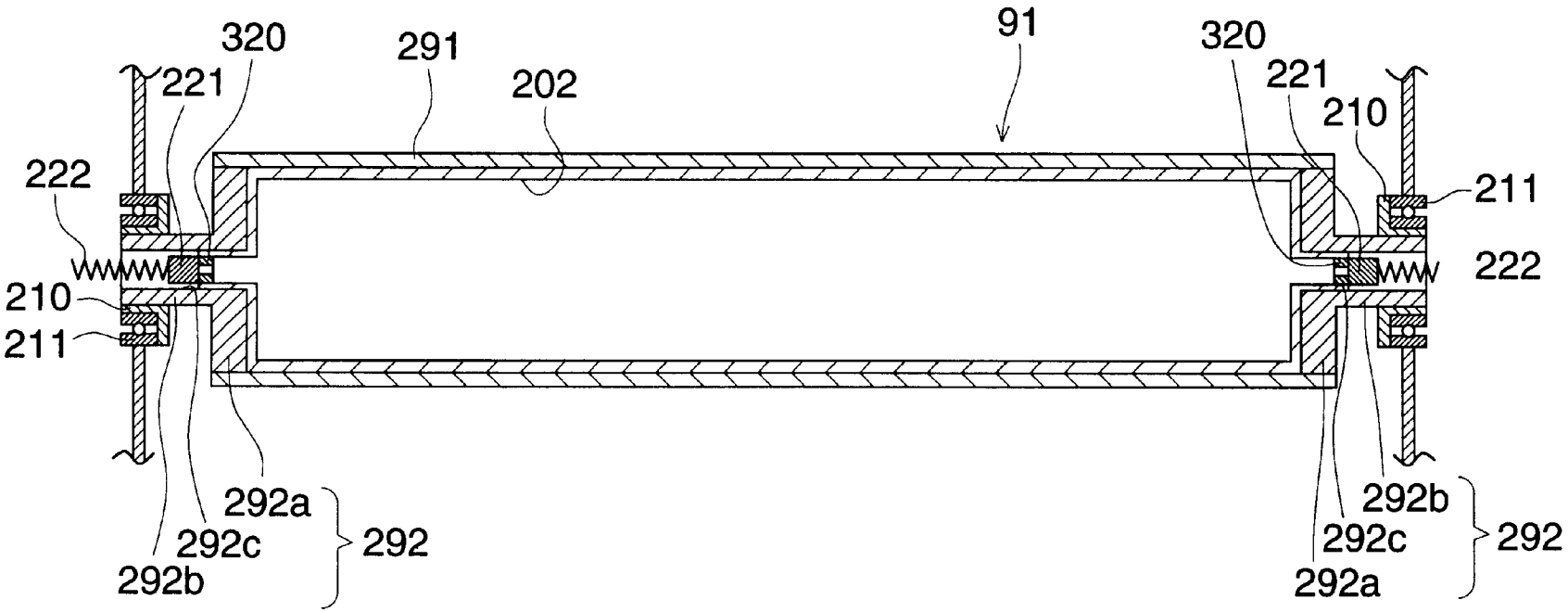
FIG. 7 is a sectional structure diagram of a heat roller in the third example.

The third example of the invention will be explained with reference to FIG. 7. FIG. 7 is a sectional structure diagram of a heat roller in the third example.

Incidentally, in the present example, parts or components which are the same as those in the second example are given the same symbols as in the second example and explanation of them will be omitted here.

Heating resistor layer 202 in the present example is formed not only on an inner circumferential surface of core metal 291 but also on fitting portion 292*a* of flange 292 and on through hole portion 292*c*.

Electrode 320 is provided on through hole portion 292*c* of flange 292. Each of both electrodes 320 has thereon several holes (each actually having a diameter of about 1–2 mm), and these holes serve as vent holes through which air expanded by heat in the heat roller flows out.

Owing to the structure stated above, a diameter of electrode 320 can be made small, in addition to the effect of the second example, which leads to cost reduction.

An applied example of the second example will be explained as follows.

Figure 11:
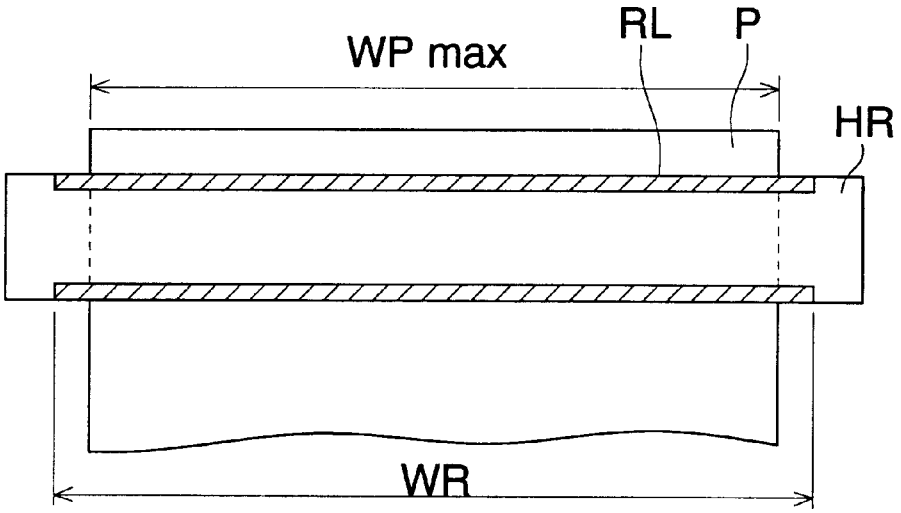
FIG. 11 (a) PRIOR ART
FIG. 11 shows diagrams wherein the structure FIG. 11(*b*) of a heat roller used for a fixing device of the invention is compared with the structure FIG. 11(*a*) of a heat roller in the prior art.
Figure 11:
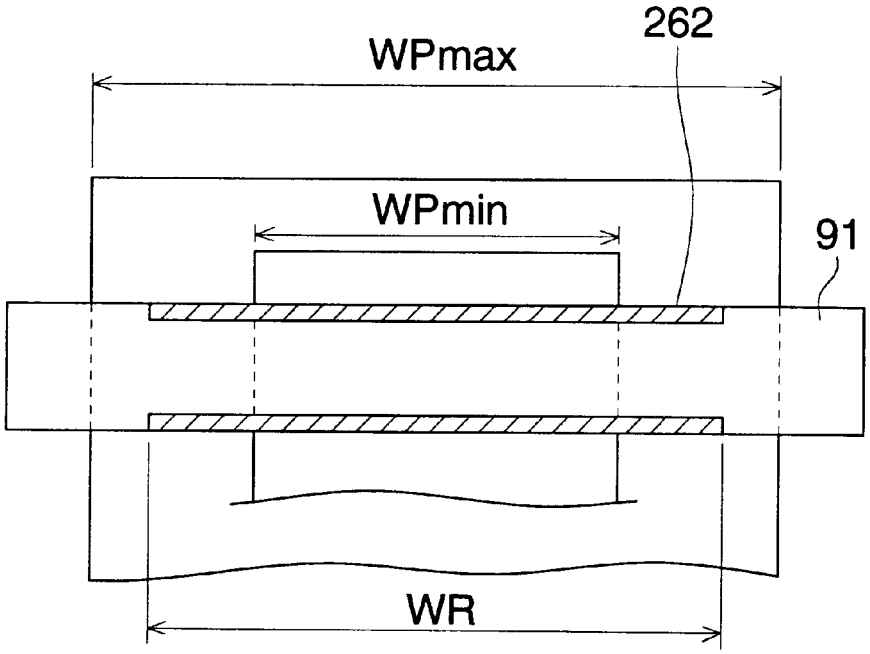
Figure 12:
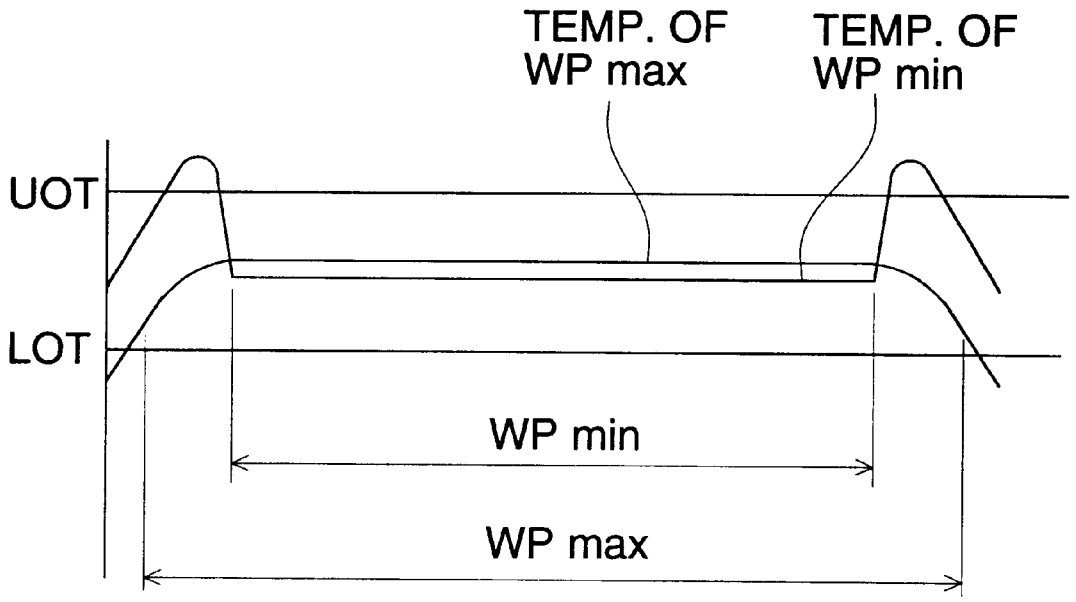
FIG. 12 PRIOR ART
FIG. 12 is a diagram illustrating temperature distribution in the axial direction of the heat roller shown in FIG. 11(*a*).

Incidentally, as shown in FIG. 6 and FIG. 11(*b*), the width (WR) of heating resistor layer 202 of heat roller 91 in the axial direction of the roller in the applied example is made to be not more than the maximum sheet-conveyance width (WPmax) and not less than the minimum sheet-conveyance width (WPmin).

Figure 8:
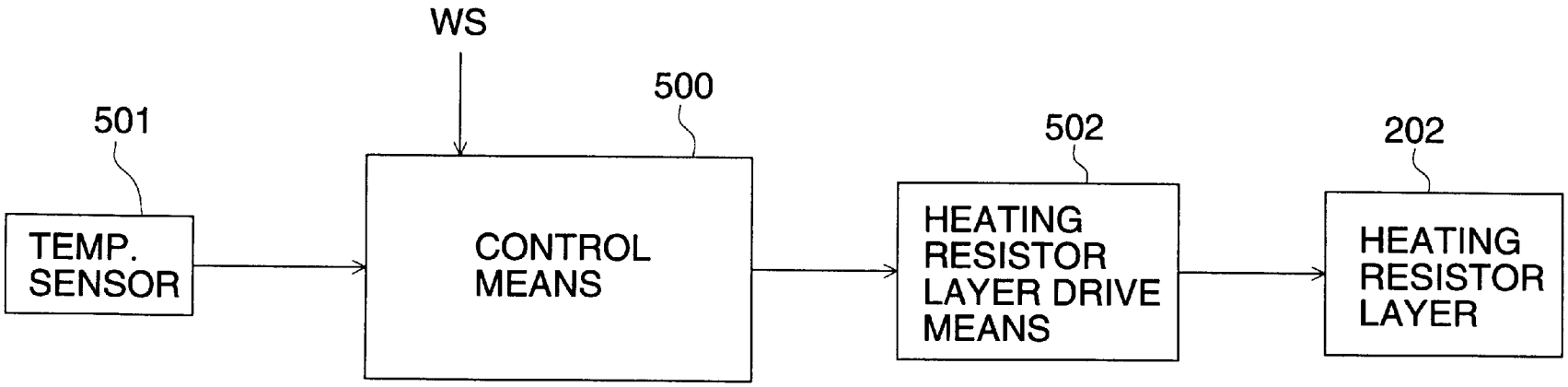
FIG. 8 is a diagram illustrating electric structure of the fixing device shown in FIG. 1

Next, the electrical structure of fixing device 90 will be explained as follows with reference to FIG. 8. In the drawing, the numeral 501 represents a temperature sensor which is provided in the vicinity of heat roller 91 of fixing device 90 and detects temperature of the heat roller 91, while the numeral 500 represents a control means which takes in signals coming from temperature sensor 501 and signals WS of recording sheet P sizes (width), and controls voltage to be impressed on heating resistor layer 202 through heating resistor layer drive means 502.

Figure 9:
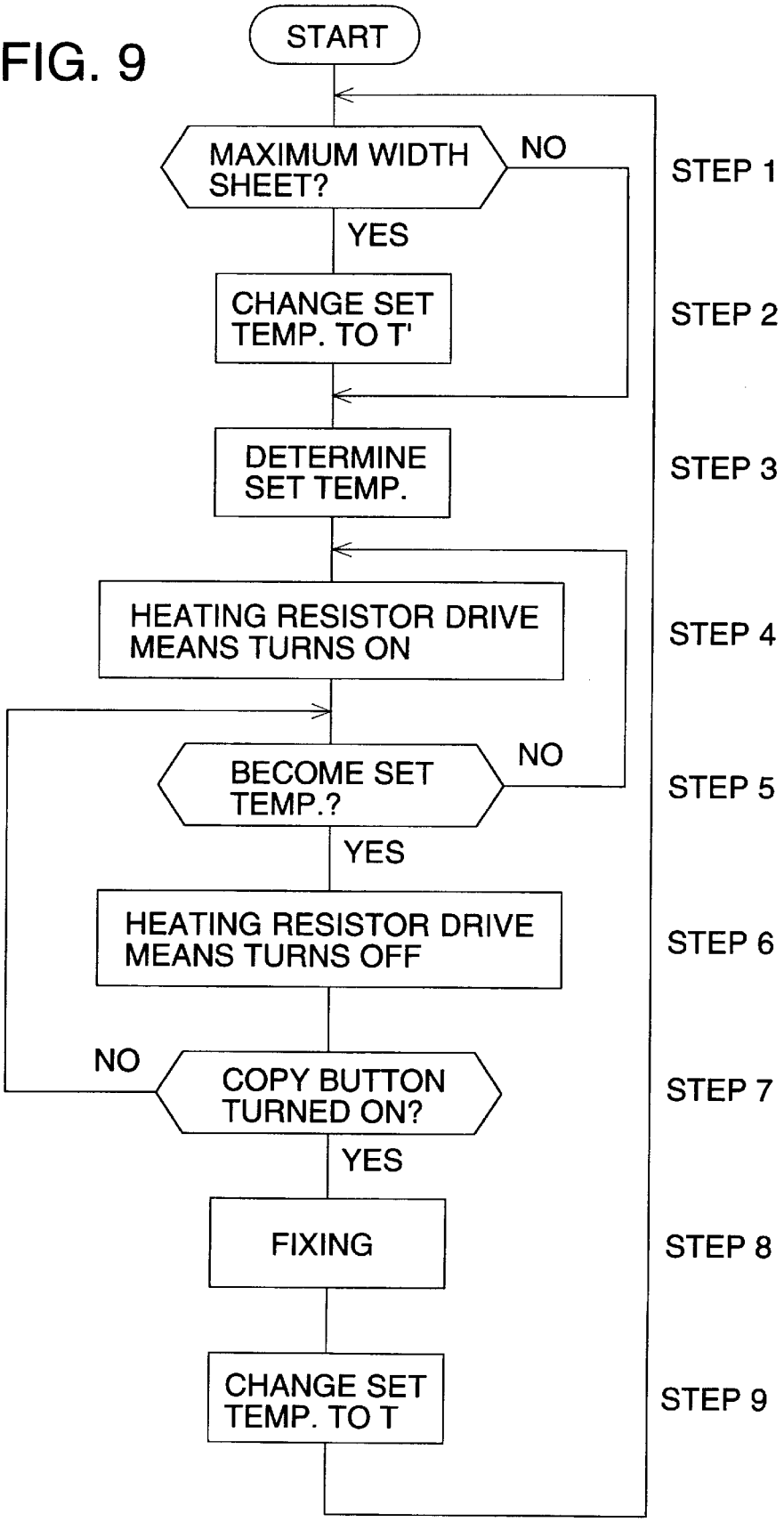
FIG. 9 is a diagram illustrating operations.

Next, operations of the fixing device 90 having the structure mentioned above will be explained, referring to FIG. 9.

(1) Control means 500 takes in sheet width signals WS of recording sheet P, and when the width of recording sheet P to be fixed is the maximum width, the control means changes the establishment temperature from T to T', while, when the width of recording sheet P is a width other than the maximum width, the control means changes the establishment temperature to T' which is an initial establishment temperature (Step 1–Step 3). Incidentally, in the present embodiment, T' is made to be T+10° C.

(2) Then, the control means takes in signals coming from temperature sensor 501, and conducts ON/OFF of heating resistor layer drive means 502 so that heat roller 91 may arrive at the establishment temperature (Step 4–Step 6). Incidentally, this temperature control continues to be carried out until a copy button is turned on in Step 7.

(3) When the copy button is turned on (Step 7), toner images are fixed on recording sheet P (Step 8).

(4) When fixing is completed, the establishment temperature is changed to T which is an initial establishment temperature, and the flow returns to Step 1 (Step 9).

In the structure stated above, a simple constitution to change voltage which is impressed on heating resistor layer 202 makes it possible to fix recording sheets in any size satisfactorily.

As shown in FIGS. 11(*a*) and 11(*b*), it is also possible to make the length of heating resistor layer 202 to be shorter than the conventional one. It is therefore possible to reduce production cost and to achieve power saving.

Further, since the width of heating resistor layer 202 can be made shorter, a length of the roller in its axial direction can also be made shorter, and an apparatus can be made small.

Owing to heating resistor layer 202 which is formed on an inner circumferential surface of core metal 291, the core metal 291 serves as a heat reservoir, and heat radiation from both ends lessens, whereby, it is possible to make the temperature difference in the axial direction of the heat roller small.

Establishment temperature

T=190° C. (recording sheet with small width size)

T'=200° C. (recording sheet with maximum width size)

Figure 10:
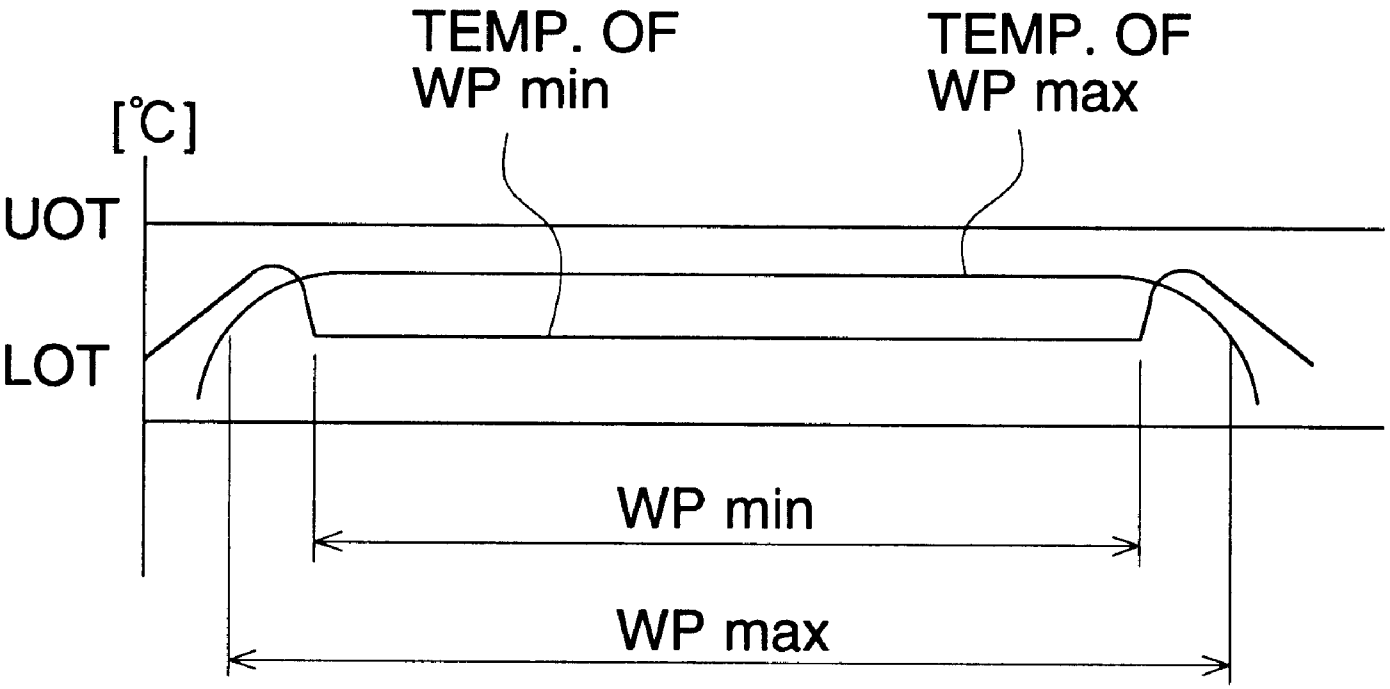
FIG. 10 is a diagram showing effects of an applied example.

FIG. 10 shows temperature distribution of a heat roller in its axial direction obtained when fixing a recording sheet with a maximum width and a recording sheet with a small width size by the use of the heat roller mentioned above.

As stated above, the applied example of the invention makes it possible to fix recording sheets in all sizes satisfactorily through the simple constitution wherein information of a width of a recording sheet to be conveyed is taken in, and establishment temperature is raised by boosting voltage to be impressed on a heating resistor layer of the heat roller, when fixing the recording sheet having the maximum size.

Since it is possible to make the length of heating resistor layer 202 to be shorter than the conventional one, it is possible to reduce production cost and to achieve power saving.

Further, since the width of heating resistor layer can be made shorter, a length of the roller in its axial direction can also be made shorter, and an apparatus can be made small.

What is claimed is:

1. A fixing apparatus comprising:

a cylindrical heat roller having openings at ends thereof and a heating resistor layer on an inside surface thereof;

a pressure member in pressure contact with said cylindrical heat roller;

a pair of electrodes fixed in said roller and in contact with heating resistor layer; and a slip ring, slidably mounted on each of said electrodes so that electricity is supplied to said heating resistor layer through each of said electrodes, whereby said heating resistor layer generates heat, said electrodes and said slip ring at least partially filling each of said openings and wherein both ends of said cylindrical heat roller are formed so as to restrain radiating heat in said cylindrical heat roller from openings at said both ends of said cylindrical heat roller.

2. The apparatus of claim 1, wherein each area of said openings is smaller than an area of a circle formed by said inside surface at a center part in an axis direction of said cylindrical heat roller.

3. The apparatus of claim 1, wherein each diameter of said ends of said cylindrical heat roller is smaller than that at a center part in an axis direction of said cylindrical heat roller.

4. The apparatus of claim 1, wherein an inner diameter of said cylindrical heat roller at a part which does not touch a recording material is smaller than that of said cylindrical heat roller at a part which touches the recording material.

5. The apparatus of claim 4, wherein each of said electrodes is provided at the inside of said part which does not touch the recording material.

6. The apparatus of claim 1, wherein said cylindrical heat roller comprises a pair of caps to close said openings at said both ends.

7. The apparatus of claim 6, wherein each of said electrodes is provided at an inside part of each of said caps.

8. The apparatus of claim 6 further comprising support members which rotatably support said cylindrical heat roller, wherein said caps are rotatably supported by said support members.

9. The apparatus of claim 6, wherein each heat conductivity of said caps is lower than that of a cylindrical member of said cylindrical heat roller.

10. An image forming apparatus having fixing element, said fixing element comprising a cylindrical heat roller having openings at ends thereof and a heating resistor layer on an inside surface thereof;

a pressure member in pressure contact with said cylindrical heat roller;

a pair of electrodes fixed in said roller and in contact with heating resistor layer; and slip ring, slidably mounted on each of said electrodes so that electricity is supplied to said heating resistor layer through each of said electrodes, whereby said heating resistor layer generates heat, said electrodes and said slip ring at least partially filling each of said openings.

* * * * *